US008063926B2

(12) United States Patent
Fukumoto

(10) Patent No.: US 8,063,926 B2
(45) Date of Patent: Nov. 22, 2011

(54) THERMAL HEAD AND THERMAL PRINTER

(75) Inventor: Yoshihiko Fukumoto, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 12/546,186

(22) Filed: Aug. 24, 2009

(65) Prior Publication Data

US 2010/0053296 A1 Mar. 4, 2010

(30) Foreign Application Priority Data

Aug. 29, 2008 (JP) ..... 2008-221675

(51) Int. Cl.
*B41J 2/335* (2006.01)
*B41J 3/34* (2006.01)
*B41J 2/345* (2006.01)

(52) U.S. Cl. ..... 347/207

(58) Field of Classification Search ..... 347/200, 347/207

See application file for complete search history.

(56) References Cited

U.S. PATENT DOCUMENTS

| | | | | | |
|---|---|---|---|---|---|
| 4,587,399 | A * | 5/1986 | Higeta et al. | ..... | 347/207 |
| 5,095,318 | A * | 3/1992 | Sugiyama | ..... | 347/207 |
| 5,157,414 | A * | 10/1992 | Seino et al. | ..... | 347/207 |
| 2010/0053294 | A1 * | 3/2010 | Fukumoto | ..... | 347/200 |

FOREIGN PATENT DOCUMENTS

| | | | | | |
|---|---|---|---|---|---|
| JP | 60-137670 | * | 7/1985 | ..... | 347/200 |
| JP | 61-293869 | * | 12/1986 | ..... | 347/200 |
| JP | 2-137943 | | 5/1990 | | |
| JP | 3-175058 | * | 7/1991 | ..... | 347/200 |
| JP | 4-259571 | | 9/1992 | | |
| JP | 2002-254686 | | 9/2002 | | |

* cited by examiner

*Primary Examiner* — Huan Tran
(74) *Attorney, Agent, or Firm* — Fitzpatrick, Cella, Harper & Scinto

(57) ABSTRACT

The present invention has an object to reduce a thickness of a protecting film having a small thermal conductivity. A thermal head includes: a plurality of heat generating resistors formed via an insulating layer; a driver circuit unit for driving the plurality of heat generating resistors to generate a heat; a wiring for connecting the driver circuit unit to the plurality of heat generating resistors; a protecting film formed to cover the plurality of heat generating resistors, the driver circuit unit and the wiring, wherein the plurality of heat generating resistors, the driver circuit unit, the wiring 11 and the protecting film are formed on a substrate, and wherein a thermal conductor having a thermal conductivity larger than that of the protecting film is disposed on the protecting film, in opposition to each of the plurality of heat generating resistors.

7 Claims, 3 Drawing Sheets

THERMAL HEAD AND THERMAL PRINTER

BACKGROUND OF THE INVENTION

1. Field of the Invention

The present invention relates to a thermal head and a thermal printer, and more particularly to a thermal head and a thermal printer using a single crystalline silicon substrate.

2. Description of the Related Art

In recent years, thermal heads for performing thermosensitive recording by selective heat generation of a heat generating element have been used.

Japanese Patent Application Laid-Open No. H02-137943 discloses a thermal head using a single crystalline silicon substrate.

The thermal head disclosed in Japanese Patent Application Laid-Open No. H02-137943 includes: a heat generating element formed on a single crystalline silicon substrate via an insulating film; a driver circuit unit formed on the single crystalline silicon substrate; a wiring layer for connecting the driver circuit unit to the heat generating element; and a protecting film for protecting a thermal head surface.

The protecting film contacts a printing medium such as an ink sheet and thus requires abrasion resistance, and is formed of a hard insulating layer of $SiO_2$, $Si_3N_4$, SiON or $Ta_2O_5$ having a thickness of several μm.

The insulating film used as the protecting film in Japanese Patent Application Laid-Open No. H02-137943 has a small thermal conductivity, and for example, $SiO_2$ has a thermal conductivity of 0.9 W/m·K, and $Si_3N_4$ has a thermal conductivity of 16 W/m·K.

The insulating film has the large thickness of several μm for providing abrasion resistance, and thus it takes a long time for heat generated by the heat generating element to transfer to the printing medium to increase a printing time.

An insulating film between the heat generating element and the silicon substrate has an equal thermal conductivity to that of the protecting film, but has a thickness of around 1 μm smaller than that of the protecting film.

Further, the silicon substrate has a large thermal conductivity of 152 W/m·K, and thus thermal energy generated by the heat generating element easily escapes toward a heat sink to cause a large loss of the thermal energy.

The present invention has an object to reduce a thickness of a protecting film having a small thermal conductivity.

SUMMARY OF THE INVENTION

In order to achieve the above described object, the present invention provides a thermal head comprising: a plurality of heat generating resistors; a driver circuit unit for driving the plurality of heat generating resistors to generate a heat; a wiring for connecting the driver circuit unit to the plurality of heat generating resistors; a passivation film formed to cover the plurality of heat generating resistors, the driver circuit unit and the wiring, wherein the plurality of heat generating resistors, the driver circuit unit, the wiring and the protecting film are formed on a common semiconductor substrate, and wherein a thermal conductor having a thermal conductivity larger than that of the passivation film is disposed on the passivation film, in opposition to each of the plurality of heat generating resistors.

Further features of the present invention will become apparent from the following description of exemplary embodiments with reference to the attached drawings.

DESCRIPTION OF THE EMBODIMENTS

Now, an exemplary embodiment for carrying out the present invention will be described with reference to the accompanying drawings.

The accompanying drawings, which are incorporated in and constitute a part of the specification, illustrate embodiments of the invention and, together with the description, serve to explain the principles of the invention.

Figure 1:
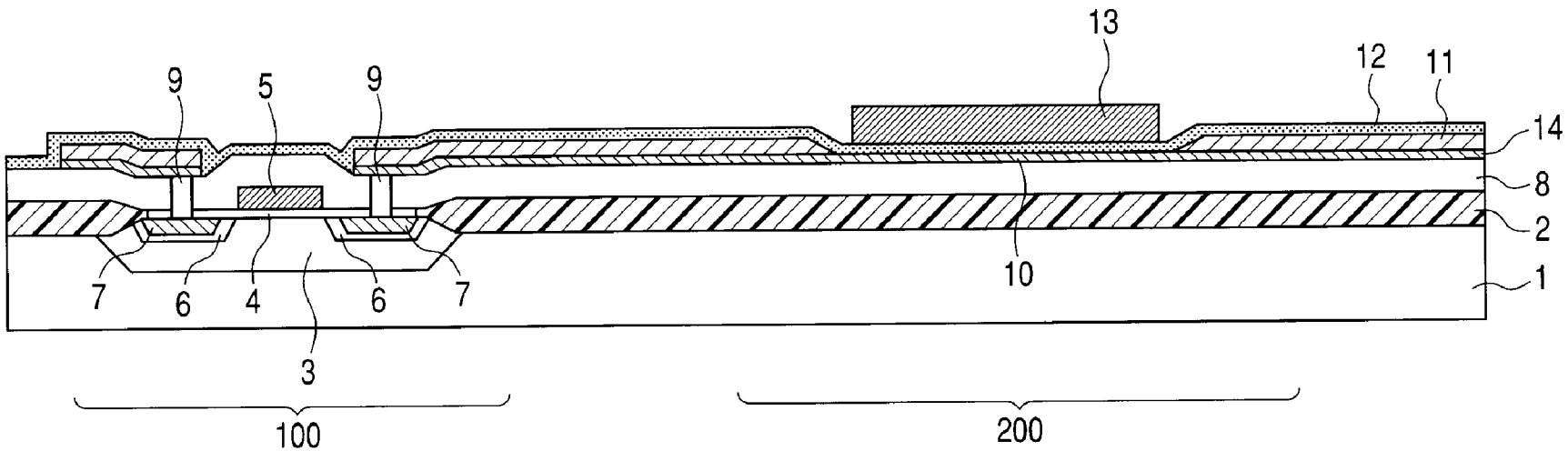
FIG. 1 is a sectional view of a configuration of a thermal head according to an embodiment of the present invention.

FIG. 1 is a sectional view of a configuration of a thermal head according to an embodiment of the present invention.

FIG. 1 shows a single crystalline silicon substrate 1, a field oxide film 2, a p-type well 3, a gate oxide film 4, a gate electrode 5, an n-type field relief region 6, n-type source and drain regions 7, an interlayer film 8, and a contact plug 9. Also shown are a heat generating resistor 10, a wiring 11, a protecting film (passivation film) 12, a thermal conductor 13, and a heat generating resistor material layer 14. The heat generating resistor 10 refers to a portion on which the wiring 11 is not formed on the heat generating resistor material layer 14.

The heat generating resistor 10 is formed from TaSiN, and provided on the single crystalline silicon substrate 1 via the field oxide film 2 and the $SiO_2$-based interlayer film 8.

The heat generating resistor 10 may be formed from a high resistance material such as a Ta-based compound, a W-based compound, a Cr-based compound or an Ru-based compounds, as well as TaSiN.

In this embodiment, the single crystalline silicon substrate is used as a substrate, but any substrates on which general semiconductor devices can be formed may be used. Specifically, an insulator substrate on which a polysilicon TFT is formed in a thin film process or a GaAs substrate may be used.

A driver circuit unit 100 for supplying a desired voltage and current to the heat generating resistor 10 is formed on a surface of the single crystalline silicon substrate 1. The driver circuit unit 100 includes a MOS transistor. The MOS transistor includes the p-type well 3 formed by ion implantation and heat treatment, the gate oxide film 4, the gate electrode 5, the n-type field relief region 6 and the n-type source and drain regions 7.

The case where the driver circuit unit 100 includes an n-type MOS transistor is herein illustrated, but the driver circuit unit 100 may include a p-type MOS transistor or a CMOS transistor. An example of an offset MOS transistor configuration is herein illustrated, but a DMOS (Double Diffused MOS) transistor configuration may be used. The offset MOS transistor has a configuration in which a semiconductor region (the field relief region 6 in FIG. 1) having a low concentration is arranged near a gate electrode of source and drain regions.

The heat generating resistor 10 is connected to the source or drain region of the MOS transistor included in the driver circuit unit 100 by the wiring 11 of Al alloy and the contact plug 9 arranged in a contact hole.

An example of the wiring 11 in one layer is illustrated, but a wiring in a plurality of layers may be used.

The heat generating resistor 10 is formed by the following method.

Specifically, the heat generating resistor material layer that constitutes the heat generating resistor 10 and a wiring material layer that constitutes the wiring 11 are formed in a laminated manner, and then the wiring material layer and the heat generating resistor material layer are simultaneously patterned to form a desired pattern by photolithography and dry etching.

A region other than a heat generating portion (a heat generating resistor forming portion) on the wiring material layer is covered with photoresist by photolithography, and for example, a phosphate-based etching liquid is used to selectively remove the wiring material layer by etching and expose the heat generating resistor material layer.

The protecting film 12 is formed to cover the entire surface of the thermal head including the heat generating resistor 10, the wiring 11 and the driver circuit unit 100. The protecting film 12 requires durability for reliability such as insulating properties and moisture resistance, and thus a hard insulating film of $Si_3N_4$ or the like can be used. The portion from which the wiring material layer is removed on the heat generating resistor material layer is the heat generating resistor 10.

The heat generating resistor 10, the driver circuit unit 100, the wiring 11 for connecting the driver circuit unit to the heat generating resistor and the protecting film 12 are formed on the common substrate 1.

In this embodiment, the thermal conductor 13 having a thermal conductivity larger than that of the protecting film 12 is disposed on the protecting film 12, in opposition to each of the plurality of heat generating resistors 10.

The thermal conductor 13 needs to quickly transfer thermal energy generated by the heat generating resistor 10 to a printing medium such as an ink sheet, and can be formed from a material having a large thermal conductivity. The thermal conductor 13 can have a thermal conductivity larger than that of the protecting film 12 so that heat transfer of the thermal conductor 13 is not limited when heat generated by the heat generating resistor 10 is transferred to the printing medium. Further, the thermal conductor 13 contacts directly the printing medium and thus requires abrasion resistance.

In terms of the above, metal materials such as Ta having a thermal conductivity of 52 W/m·K, Mo having a thermal conductivity of 138 W/m·K and W having a thermal conductivity of 154 W/m·K and alloy materials thereof having a large thermal conductivity and high mechanical strength can be used. Non-metal materials such as SiC having a thermal conductivity of 98 W/m·K having a large thermal conductivity and high abrasion resistance may be also used.

The thermal conductor 13 can be formed by an etching technique using photolithography, and can be formed to have an arbitrary pattern.

Figure 2:
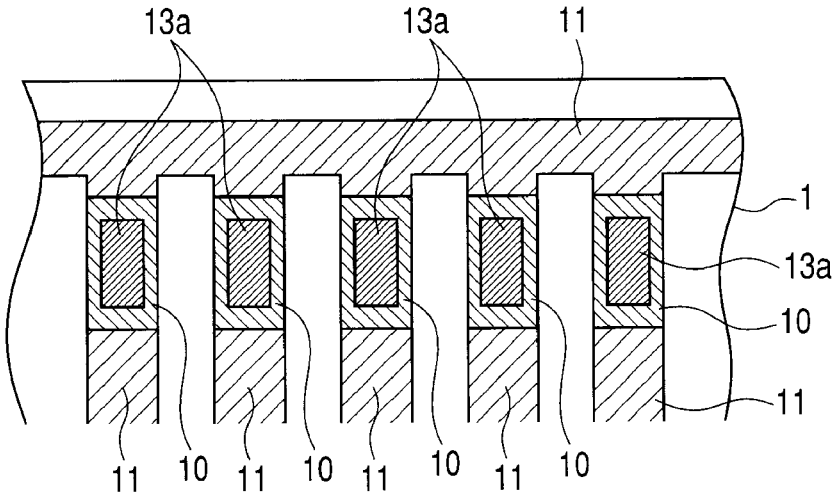
FIG. 2 is a top plan view of a heat generating element 200 of the thermal head according to the embodiment of the present invention.
Figure 3:
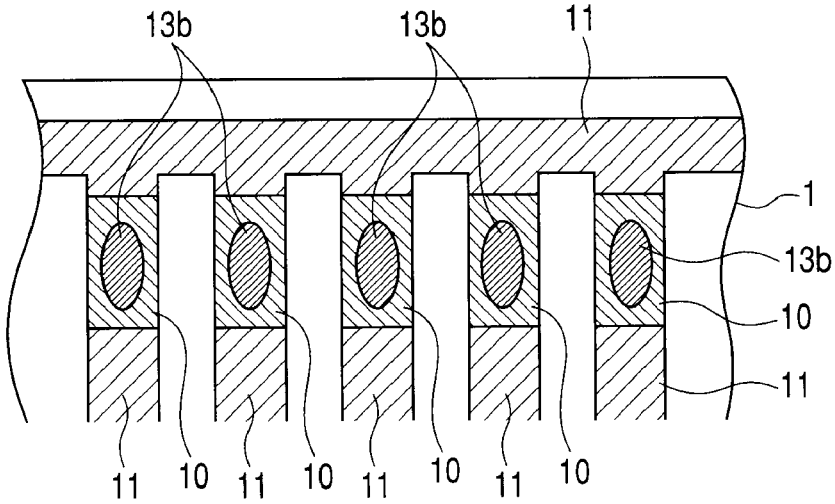
FIG. 3 is a top plan view of the heat generating element 200 of the thermal head according to the embodiment of the present invention.

FIGS. 2 and 3 are top plan views of a heat generating element 200 of the thermal head according to this embodiment.

As illustrated in FIG. 2 or 3, the thermal conductor may have an appropriate shape according to a printing characteristic as indicated by reference numerals 13*a* or 13*b*. The thermal conductor has a rectangular shape in FIG. 2 and an oval shape in FIG. 3. All thermal conductors do not need to have the same shape and size, though not illustrated. The thermal conductor may be larger or smaller than the heat generating resistor 10, and can be formed to have a desired pattern according to a required printing characteristic.

Adjacent thermal conductors are desirably formed separately so as to prevent mixing of thermal energy thereof.

Figure 4:
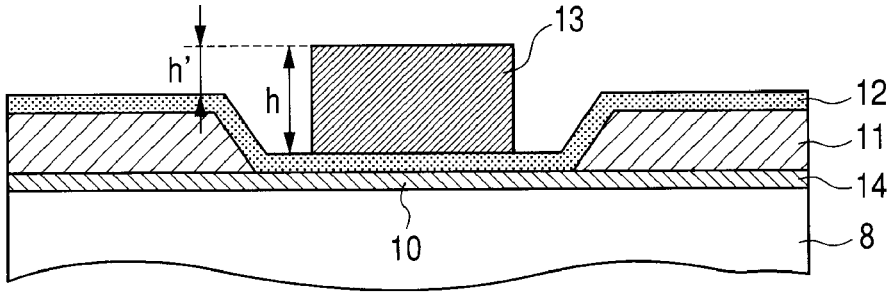
FIG. 4 is an enlarged sectional view of the heat generating element 200 in FIG. 1.

FIG. 4 is an enlarged sectional view of the heat generating element 200 in FIG. 1.

As illustrated in FIG. 4, a thickness h of the thermal conductor 13 can be controlled by a film thickness of a thermal conductor material. For example, a film having an arbitrary thickness can be formed by a sputtering technique.

The thermal conductor 13 is desirably formed from a metal material selected from Ta, W. Cr and Ru, a metal compound of any one or more of Ta, W, Cr and Ru, or SiC.

In order to satisfy abrasion resistance capable of printing of a distance equal to or longer than 4 Km required as durability of a thermal head, a Ta-based, Mo-based or W-based material can have a thickness larger than 0.2 μm in terms of mechanical strength.

The thermal conductor 13 contacts directly the printing medium. Thus, an outermost surface thereof protrudes upwardly rather than the protecting film 12 on the wiring 11, thereby allowing satisfactory contact with the printing medium and increasing printing quality. An amount of protrusion of the thermal conductor 13 (a distance between a surface of the protecting film and an upper surface of the thermal conductor) h' can be controlled by a film thickness of the thermal conductor material, and can be set according to a required printing characteristic.

With the above described configuration, the protecting film 12 having a small thermal conductivity can be reduced in thickness to increase printing speed. Simultaneously, a loss of thermal energy generated by the heat generating resistor 10 is reduced to provide a thermal head with low power consumption. The thermal energy generated by the heat generating resistor is quickly transferred to the printing medium through the thin protecting film and the thermal conductor having a large thermal conductivity, thereby further increasing the printing speed. Further, the increase in the printing speed reduces an amount of escape of the thermal energy generated by the heat generating resistor toward a heat sink, thereby reducing power consumption.

Next, a thermal printer using the above described thermal head will be described.

The thermal printer according to this embodiment uses a sublimation thermal transfer recording system in a printer unit thereof, and prints images represented by electronic image information on an arbitrary number of papers. Such a thermal printer is described in Japanese Patent Laid-Open No. 2002-254686.

Figure 5:
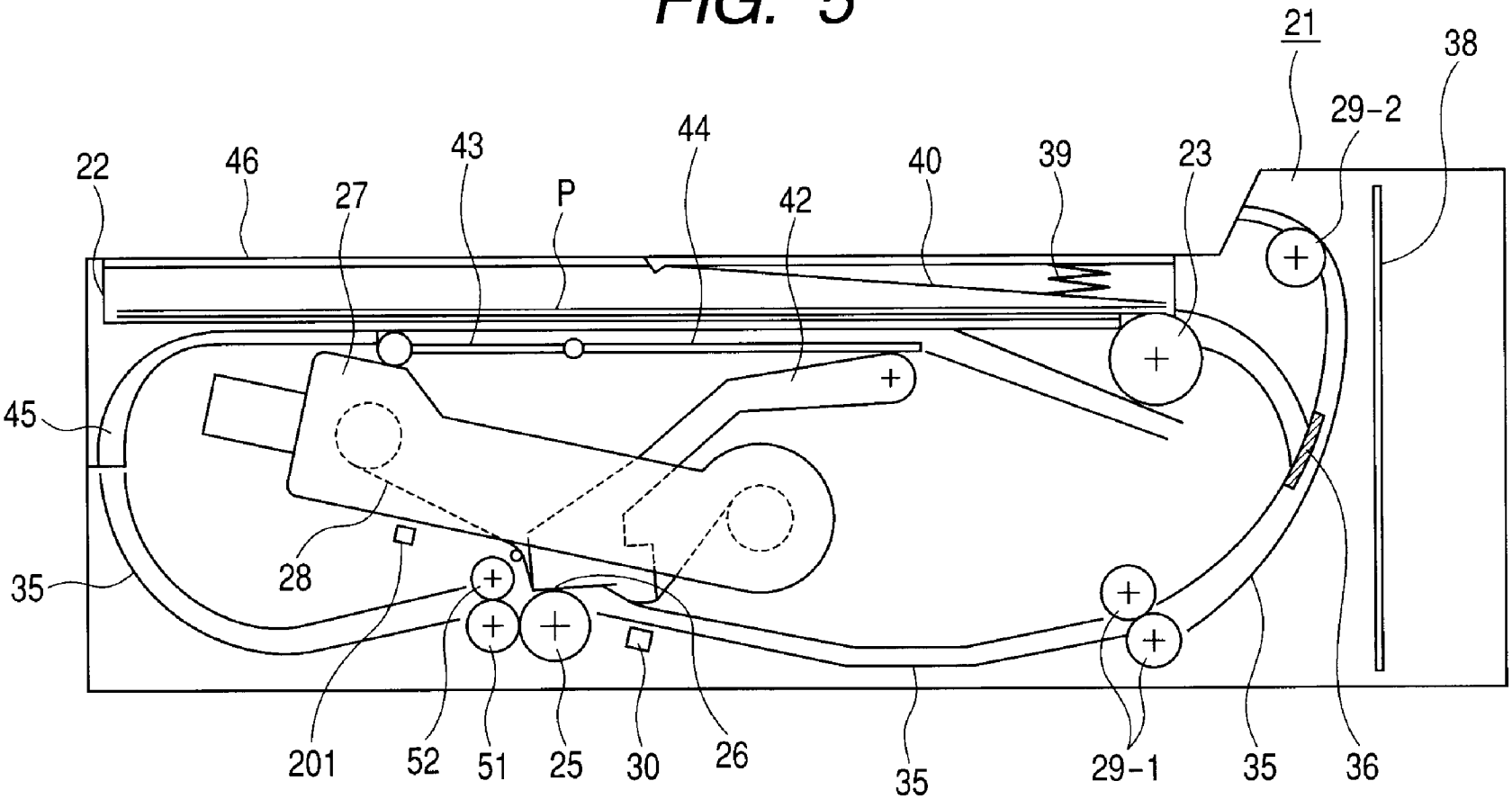
FIG. 5 is a sectional view of a thermal printer according to an embodiment of the present invention.

FIG. 5 is a sectional view of the thermal printer according to an embodiment of the present invention.

A control circuit 38 in a body 21 of the thermal printer includes a CPU, a RAM and a ROM, and controls configurations of the body 21 described later to perform processes and operations described later.

Recording papers P that are recording media stacked in a paper cassette 22 are abutted against a paper feed roller 23 by a push-up plate 40 urged by a spring 39, separated one by one by the paper feed roller 23, and supplied to a recording unit via a guide 35. A grip roller 51 and a pinch roller 52 that are a pair of rollers disposed in the recording unit hold and convey the supplied recording paper P to allow the recording paper P to be reciprocated in the recording unit.

In the recording unit, a platen roller 25 and a thermal head 26 are disposed to face each other on opposite sides of a conveying path of the recording paper. An ink sheet 28 is housed in a cassette 27. The ink sheet 28 has an ink layer on which hot-melt or thermal sublimation ink is applied and an overcoat layer coated over a print surface to protect the print surface. The thermal head 26 presses the ink sheet 28 onto the recording paper P, and heat generating elements of the thermal head 26 are selectively driven to generate heat to transfer ink onto the recording paper P and transfer and record images. A protecting layer is coated over the transferred image.

The ink sheet 28 has a width substantially equal to that of a print region of the recording paper P (a region perpendicular to a conveying direction). In a longitudinal direction of the ink sheet 28, ink layers of yellow (Y), magenta (M) and cyan (C) of the size substantially equal to that of the print region (the region in the conveying direction) and an overcoat (OP) layer are successively arranged alternatingly. Thus, thermal transfer of one layer is performed, then the recording paper P is returned to a recording start position, and then thermal transfer of the next layer is performed, thereby allowing the four layers to be successively transferred (superimposed) onto the recording paper P. In other words, the recording paper P is reciprocated in a transfer position the number of times corresponding to the total number of ink colors and the overcoat layer by the pair of rollers 51 and 52.

The recording paper P after printing is reversed in its conveying direction and guided rearwardly of the body 21 by the guide 35 on the front of the body 21 (on the left in FIG. 5) and a paper conveying guide 45 provided in a lower front portion of the paper cassette 22. The recording paper P after printing is reversed on the front of the body 21, and thus the recording paper P during printing is not placed outside the body 21. This prevents waste of space to save space for placement of the apparatus, and also prevents the recording paper P from being unintentionally touched. Also, the structure in which the lower portion of the paper cassette 22 is directly used as a part of the guide can reduce the thickness of the body 21. Further, the recording paper P is passed through a space between the cassette 27 and the paper cassette 22, thereby minimizing a height of the body 21 and reducing the size of the apparatus.

After printing, the recording paper P conveyed rearwardly of the body 21 is guided by pairs of delivery rollers 29-1 and 29-2 from the rear to the front of the body 21 and delivered to a paper output tray 46. The pair of rollers 29-1 are configured to be brought into pressure contact with each other just during delivery of the recording paper P so as not to apply stress to the recording paper P during printing. An upper surface of the paper cassette 22 also serves as a tray for the recording paper P delivered after printing, and this also reduces the size of the apparatus.

A conveying path switching sheet 36 switches the conveying path so as to guide the recording paper P to a delivery path after the recording paper P is supplied to the recording unit.

The thermal head 26 is integrated with a head arm 42, and in replacement of the cassette 27, the thermal head 26 is retracted to a position in which the cassette 27 can be removed without trouble. The cassette 27 can be replaced by withdrawing the paper cassette 22. Specifically, the head arm 42 is pressed by a cam portion of the paper cassette 22, but as the cam portion is retracted by withdrawing the paper cassette 22, the head arm 42 is retracted upwardly to allow replacement of the cassette 27. Front end detection sensor 30 detects a front end of a paper. Head covers 43 and 44 cover the thermal head.

The present invention can be applied to a thermal printer using a thermal head such as a sublimation printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-221675, filed Aug. 29, 2008, which is hereby incorporated by reference herein in its entirety.

What is claimed is:

1. A thermal head comprising:

a plurality of heat generating resistors;

a driver circuit unit configured to drive the plurality of heat generating resistors to generate a heat;

a wiring configured to connect the driver circuit unit to the plurality of heat generating resistors;

a passivation film formed to cover the plurality of heat generating resistors, the driver circuit unit and the wiring, wherein the plurality of heat generating resistors, the driver circuit unit, the wiring, and the passivation film are formed on a common semiconductor substrate; and a thermal conductor having a thermal conductivity larger than that of the passivation film and disposed on the passivation film to directly contact a printing medium, in opposition to each of the plurality of heat generating resistors, the thermal conductor having a surface that protrudes upwardly to directly contact the printing medium rather than a surface of the passivation film.

2. The thermal head according to claim 1, wherein the wiring is arranged so as not to be disposed at a position in which the thermal conductor is formed.

3. The thermal head according to claim 1, wherein the thermal conductor is formed from a metal material selected from the group consisting of Ta, W, Cr and Ru, or a metal compound material of any one or more of Ta, W, Cr and Ru, or SiC.

4. The thermal head according to claim 1, wherein the thermal conductor has a thickness larger than 0.2 μm.

5. The thermal head according to claim 1, wherein the substrate is formed from a single crystalline silicon.

6. The thermal head according to claim 1, wherein the driver circuit unit includes an MOS transistor, and the passivation g film is arranged to cover the MOS transistor.

7. A thermal printer comprising:

a thermal head according to claim 1, wherein the thermal head transfers an ink from an ink sheet to a recording medium for recording.

* * * * *